US005294086A

United States Patent [19]

Fantini et al.

[11] Patent Number: 5,294,086

[45] Date of Patent: Mar. 15, 1994

[54] ADJUSTABLE OLEOPNEUMATIC AMORTIZED SUPPORT COLUMN, FOR CHAIRS AND ARMCHAIRS

[76] Inventors: Lucio Fantini, Viale Ungheria 7, 33100 Udine; Claudio De Sabbata, Via Pradamano 9, 33042 Buttrio (UD); Renato De Sabbata, Via Drusin 11/A, 33044 Manzano (UD), all of Italy

[21] Appl. No.: 768,041

[22] Filed: Oct. 1, 1991

[51] Int. Cl.[5] ..... F16M 13/00

[52] U.S. Cl. ..... 248/631; 267/64.15; 297/344.19

[58] Field of Search ..... 248/631, 619, 636; 267/64.15, 131; 297/347, DIG. 3

[56] References Cited

U.S. PATENT DOCUMENTS

| | | | |
|---|---|---|---|
| 3,787,019 | 1/1974 | Freitag | 248/631 X |
| 4,085,925 | 4/1978 | Peddinghaus et al. | 267/64.15 |
| 4,124,202 | 11/1978 | Hatakeyama | 267/131 X |
| 4,245,826 | 1/1981 | Wirges | 267/131 |
| 4,503,951 | 3/1985 | Imaizumi | 267/64.15 X |
| 4,682,753 | 7/1987 | Clark | 248/631 X |
| 4,720,068 | 1/1988 | Tornero | 248/631 X |
| 4,756,496 | 7/1988 | Hosan et al. | 248/631 X |
| 5,097,928 | 3/1992 | Enders et al. | 267/64.15 X |

FOREIGN PATENT DOCUMENTS

| | | |
|---|---|---|
| 0343339 | 3/1989 | European Pat. Off. . |
| 1529432 | 11/1965 | Fed. Rep. of Germany . |
| 8807828 | 10/1988 | PCT Int'l Appl. . |

*Primary Examiner*—David A. Scherbel
*Assistant Examiner*—Korie H. Chan
*Attorney, Agent, or Firm*—Harrison & Egbert

[57] ABSTRACT

An oleopneumatic adjustable and deadened support column for a chair having a first cylindrical body, a second cylindrical body, a command bar, a first slidable piston between the first and second body, an annular upper floating piston and an annular lower floating piston, and a valve contained within the second body. The first cylindrical body is connected to a base of a chair and is charged with compressed air. The second cylindrical body is coaxial and telescopically slidable within the first cylindrical body. The upper end of the second body is adapted to be connected to a seat of a chair. The command bar is a lever positioned under the chair seat. The first piston is annularly fixed around the second body and in sliding sealing engagement with the inner surface of the first body. The upper and lower pistons define upper and lower oil chambers between the first and second bodies. The valve is actuable by the command bar so as to control a flow of oil between the first and second oil chambers.

8 Claims, 3 Drawing Sheets

ADJUSTABLE OLEOPNEUMATIC AMORTIZED SUPPORT COLUMN, FOR CHAIRS AND ARMCHAIRS

TECHNICAL FIELD

The present invention relates to an adjustable oleopneumatic deadened support column, for chairs and armchairs.

The innovation finds particular if not exclusive application as a support spring structure adjustable in height for office chairs.

BACKGROUND ART

In the prior art, adjustable oleopneumatic deadened support columns with an oil and air chamber in the column are known. For instance, DE-1529432 (Bilstein) describes an adjustable central oleopneumatic support column, particularly for chairs, comprising: a first tube, the base of which is rigidly connected to the base of a chair, and a second, superior, tube, telescopically inserted into the first and coaxially slidable within it, with its upper end secured under the seat of the chair. An internal command coaxial bar is vertically movable by a lever under the seat, and extends within the first and second tubes. It is associated with first piston means, slidable inside the first tube forming two chambers, respectively an upper chamber and a lower chamber, containing oil, with valve means to allow or to prevent the passage of oil from one chamber to the other, to make height variation possible by means of the actuation of said lever under the seat. Second freely slidable floating piston means in said first tube and under first piston means define and delimit said lower chamber and form a bottom chamber that contains air or compressible gas to offer a spring function.

A second column is described in IT-41632A/85d WO, A1,8807828 in the name of LIFTER SRL. This column provides a similar support with the second tube slidable internally in the first tube. The second piston means are fixed internally within the first tube and the second tube slides inside said second piston means. The bottom chamber presents a lower plug valve for charging and discharging respectively the air chamber pressure. Both the aforesaid prior art columns present substantial structural drawbacks and as such are not practicable or reliable. The first mentioned in particular does not allow an automatic elongation of the column, but for said elongation it is necessary to operate a pull in the open condition of the intercommunication device thereof. This operation is complex and tiresome for the user and overall hindered by the presence of the air chamber that yields elastically. The second column attempts to solve this problem by the presence of the second tube that is immersed as a further piston inside the bottom chamber allowing an auto elongation of the column by an intercommunication open device between the two oil chambers, but this solution presents a complex structure for fixation of the second means to the piston, resolvable only by high production costs particularly for the internal working of the first body.

Further disadvantages of the second solution are caused by a system of small valve means, principally in oil hole passageways where ring seals or gaskets must pass in reciprocation from one chamber to the other, each time that the operator actuates the command lever to lower or to lift the seat, moving such seals across open holes causing the inevitable breaking of same.

Finally, the second device does not present valid axial guide means as in the first, and therefore involves the further damaging of said seals and inevitable misalignment due to oscillation. Furthermore, it is pointed out that the column disclosed in IT-41632A/85 does not provide deadening means, and in the column of DE-1529432 (F. A. August Bilstein) the resistance to elongation causes air infiltrations due to pressure differences created during extraction in elongation of the column. The same problems are raised in EP, A, 343339 (Bansbach, Hermann), being developed substantially in the same way. In fact, EP, A, 343339 discloses one additional piston means below the first piston means. However, the functional effect of the two oil chambers acting as a whole as mentioned in this application is not achieved.

Moreover, in each of the prior art columns described above, there is the presence of a necessarily limited chamber of air. In the first for said second piston means and in the second solution for said second tube that is closed from below and acts as a substantially impenetrable piston stem.

The purpose of the present invention is to eliminate the above mentioned drawbacks.

SUMMARY OF THE INVENTION

In a broad aspect, the present invention relates to an oleopneumatic adjustable and deadened support column for a chair comprising: (i) a first cylindrical body, the base of which is adapted to be connected to the base of a chair and charged with compressed air ; (ii) a second cylindrical body, co-axial with the first, and telescopically slidable therein, the upper end of said second body being adapted to be connected to the seat of a chair; (iii) a command bar co-axial with and inside said second body, operable by lever means under said chair seat, (iv) first slidable piston means between said first and second body, said first piston means being annularly fixed around said second body, and in sliding, sealing engagement with the inner surface of said first body; (v) annular upper and lower floating piston means, respectively above and below said first piston means, between said first and second bodies, in sliding sealing engagement with same, said first, upper, and lower pistons defining upper and lower oil chambers between said first and second bodies; (vi) valve means in said second body, at the level of said first piston, actuatable by said command bar to permit or interdict the flow of oil between said first and second oil chambers; whereby said first, upper, and lower pistons are displaceable as an ensemble when weight is placed on the seat of said chair.

The column of the present invention makes possible a displacement of the oil chamber assembly inside the first body (said chambers being above a compressed air chamber) and simultaneously eliminates the decompression effect and any oil leakage that could easily happen in previous columns.

The valve means of the present invention includes an axial draw valve (axially movable by means of a lever command) that involves three ring seals and slides within said second body in an intermediate chamber formed by a cartridge-like casing assembly. The valve means of the present invention provides two series of holes, each at different height levels whereby the exertion of said draw valve displaces the ring seals, from a closed position with an intermediate sealing means between said two series of holes, blocking the flow of the oil from one chamber to the other, to an open position, with intermediate sealing means axially displaced to permit communication between the series of holes. With this solution, the seals do not deteriorate or undergo damage.

An advantage of said second body is it is hollow and moreover, has an interior opening at a lower end toward the basis chamber and extends beside and under the intercommunication device between the two oil chambers. Because the second body is interiorly hollow, the lower air/gas chamber is notably increased in volume, improving the elastic effect without modifying the external dimensions of the column. Furthermore, in the lower part of said first body, is a guide that axially guides the lower part of said second body and acts as a lower stop means for said first piston means. This stop means forms a limit on the downward motion of the second body within the first even if the pressure of the gas in the basis chamber is insufficient to hold the weight of the person sitting on the chair, either at the time of sitting down, or statically as the person is sitting.

The column of the present invention is functional even in the absence of air or gas in the chamber. By placing the valve means in an intermediate position, the seat can be placed manually to a desired height and in that locked position the valve may be put in the rest position, thereby to lock the chair at the desired height.

The present invention is described in greater detail in the following description, with reference to the accompanying drawings. The invention is not restricted to what is described and shown in the drawings, but can be changed and modified in many ways within the scope of the invention idea defined in the attached claims.

DETAILED DESCRIPTION OF THE INVENTION

Figure 1:
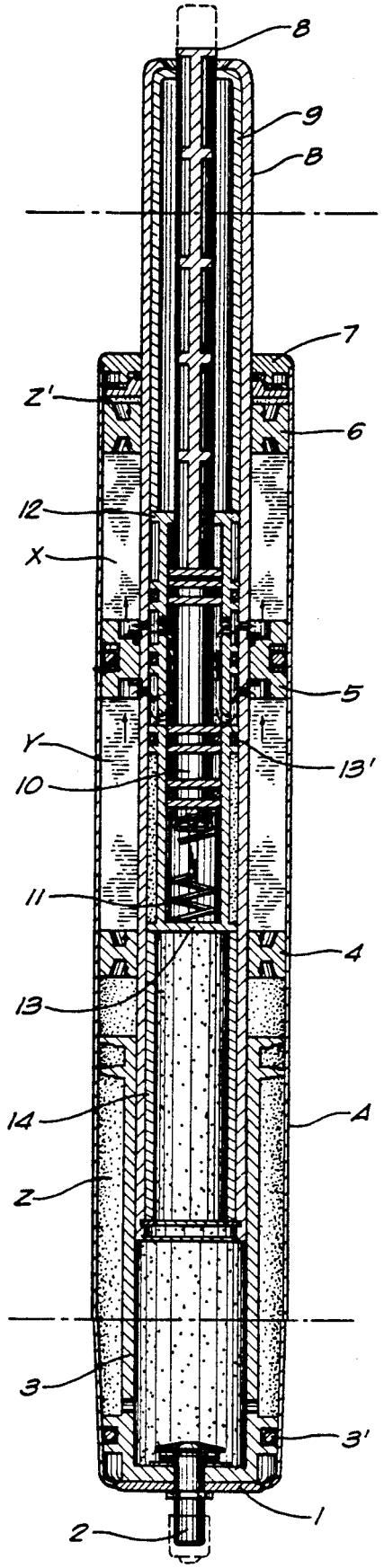
FIG. 1 represents a view of an axial section of the column.

The figures describe a chair oleopneumatic adjustable deadened column support comprising a first hollow cylindrical body A, the base of which is rigidly connected to the base of a chair (not illustrated). A second cylindrical body B is provided. Body B is an upper coaxial slidable tube inside the first body A. The upper end of second body B is secured under the seat of the said chair. A coaxial command bar 8 that is movable vertically by a conventional command lever (not illustrated) under the seat of the chair extends upwardly from second body B. Interposed between the first A and second B bodies, is first slidable piston means 5, inside the first body and circumferentially fixed around the second body B. Upper blockage means 5' and lower blockage means 5'' fix piston 5 to second body B, while inner 5'''' and outer 5'', O-ring seals are provided around piston 5 to form a division between two chambers, respectively upper and lower chambers (X and Y) containing oil, with valve means 10 to allow or to prevent the passage of oil from one chamber to the other to effect height variations. The upper and lower limits of the oil chambers are defined by two floating piston means set between said first A and second B bodies, one piston above 6 and one piston below 4.

The second body B is internally hollow and opens at its lower end toward a basis chamber Z in the first body, said basis chamber being charged with compressed air. Interiorly in said first body A in said basis chamber Z is set a cylinder guide stop 3 made of plastic material, forming an axial guide for motion of said second body B, and providing a lower stop means for the sliding piston 5, in its lowermost position. The two floating pistons (4,6) are annular in shape and are freely slidable between the first and second tubular bodies A and B. The oil chambers (X,Y) are accordingly, also floating and form two air chambers above and below the piston means, one principal lower chamber Z for deadening effect and one upper chamber for interspace Z' Interspace Z' is formed by suction between the upper floating piston 6 and the cap 7 of first body.

when the weight of the person is placed on the seat of the chair.

The structural elements of the device include, in the interior of the second body B a command bar 8 to regulate the height of the chair by allowing the flow of oil from one chamber to another, and an upper tubular stop means 9 to hold and guide the upper part of the command bar 8.

An upper piston casing 12 is provided to hold and guide the lower part of the command bar 8. Casing 12 is sealed circumferentially to the inside of body B by means of two spaced seal rings (12' and 12''), placed externally above and below a circumferential series of holes 10n' in said piston casing 12 and corresponding holes series Bn' of said second body B. Upper seal ring 12' prevents the passage of oil in the upper interspace of the second body B and lower seal ring 12'' blocks direct passage of oil through the two spaced series of holes Bn' and Bn'' of the second body B.

The valve means of the present invention comprises a piston 10 provided at the lowermost end of the command bar 8, inside the piston casing 12 with three external seal rings. An upper piston seal ring 10' prevents the passage of oil into the interspace between the command bar 8 and the guide means 9 through the axial hole above the piston casing 12. An intermediate seal ring 10'' allows or prevents the passage of oil from one chamber to the other (X,Y). A lower seal ring 10''' prevents passage of oil to the inside of the lower piston casing guide means 13. A lower casing and guide means 13 is provided. It is closed at its lower end, in the manner of a cartridge case and houses a helical spring 11 that bears against the lower end of piston 10, urging it upwardly, so that in its resting position, piston 10 is located at the upper end of casing 12.

Between lower piston casing 13 and second body B, an annular seal ring 13' is provided. This prevents the flow of oil into basis chamber Z.

A lower interior tubular stop 14 maintains the position of the lower piston casing 13.

Figure 2:
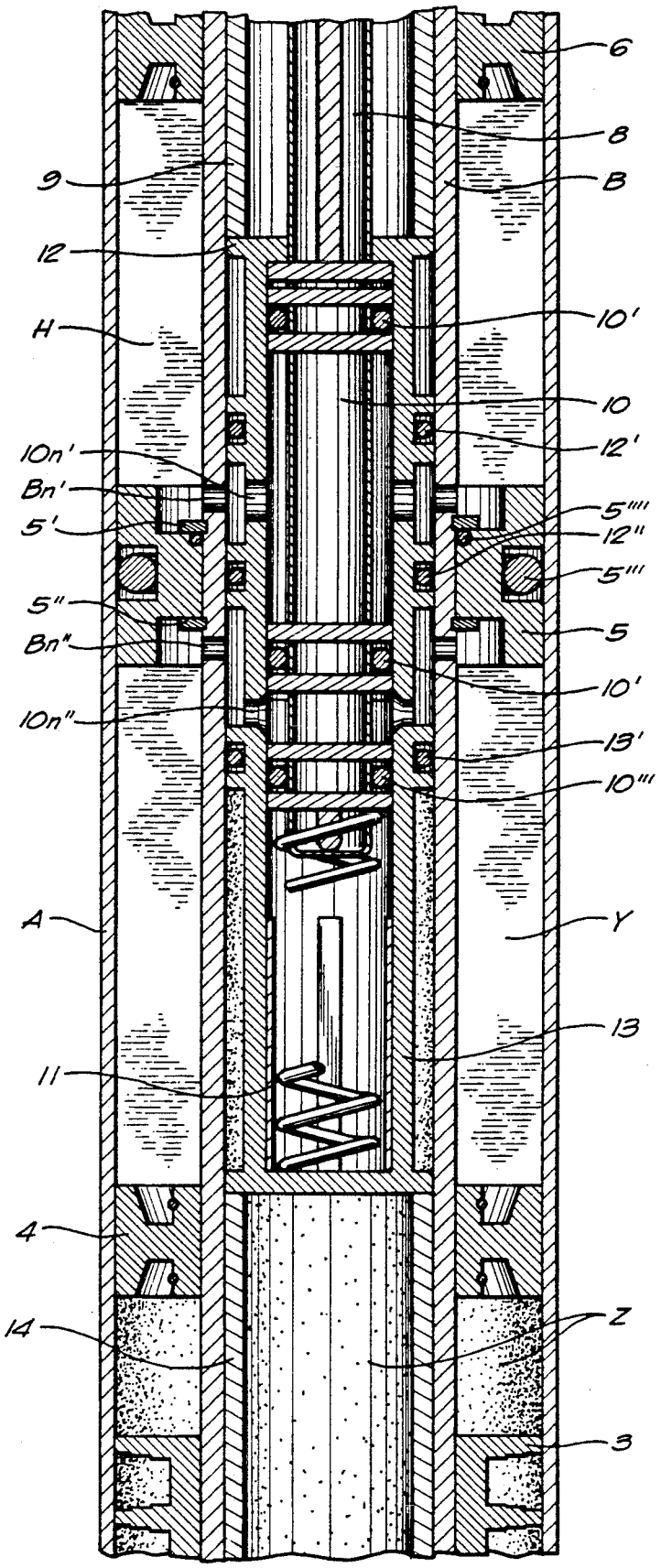
FIG. 2 represents an enlarged view in axial cross-section of the central portion of the column with the valve means in rest (closed) position.
Figure 3:
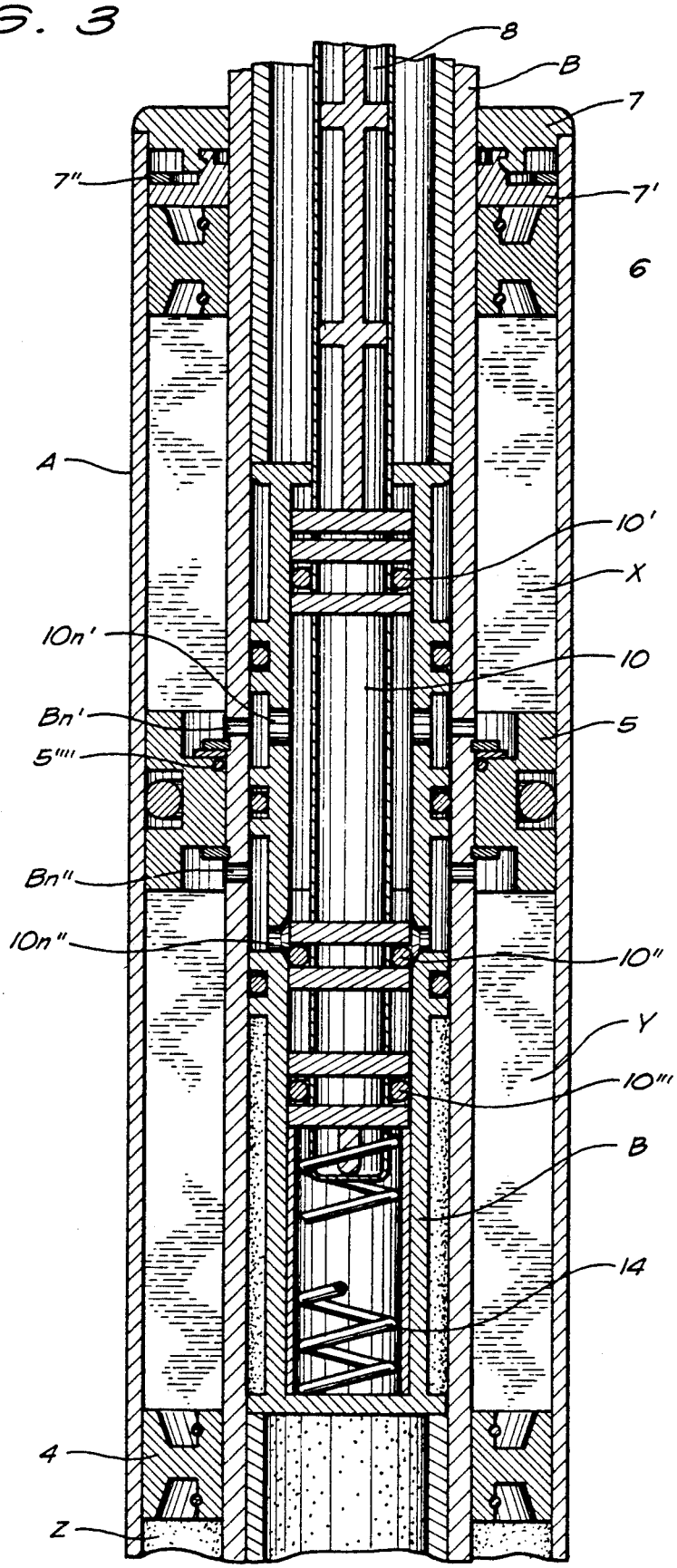
FIG. 3 represents a view with the valve means in intermediate position (open).

The movement of the piston 10 allows the interconnection and/or disconnection of the two oil chambers (X,Y). This enables the elongating or shortening of the so as to lift or lower the seat of the chair. FIG. 3 shows the passage of oil between the chambers as connected. FIG. 2 shows such passage as blocked. It will be noted that upper casing 12 and lower casing 13 are slightly spaced apart to permit the flow of oil when piston 10 is depressed, and intermediate seal 10″ moved from upper casing 12 to lower casing 13, the effect of which, as can be seen from FIG. 3 is to open a passage for oil to move from upper chamber X to lower chamber Y, if the chair seat is being raised, or vice versa, if the chair seat is being lowered. Moreover, it will be understood that, in its resting position, helical spring 11 pushes piston 10 upwardly, causing intermediate seal 10″ to enter upper casing 12, and block the flow of oil from chamber to chamber. Since the sliding movement of piston 5 requires oil to flow from chamber to chamber, then non-depression of piston 10 will freeze piston 5 between upper 6 and lower 4 floating pistons, thereby fixing the height of the chair.

The first body A is capped by a two part 7,7′ guide, that is slidingly sealed against second body B by a Seeger seal 7″. Inserts 8,9,10,12,13,14 are made of plastic material.

The channels for the passage of the oil through the valve system and the diameters of the numerous holes are selected for the controlled descent or ascent of the seat of the chair, as will be clear to one skilled in the art. In the lower part of the first body A of the column is a valve 2 in a closure 1 for charging the air chamber Z with air. As noted, in the upper part of the first cylindrical body A is inserted the upper guide 7,7″ of the second body B, made of plastic material, that is provided with a Seeger ring 7″ that allows the passage of air when weight is placed on the seat of the chair, causing the two floating seals 6,4 and, as a result, the internal oil chambers X,Y to displace as an ensemble because of effect of the compression of air in the lower chamber Z.

The elastic effect of the present invention is improved by its structure, by the air chamber assemblies, and by increasing the volume of air in the air chamber. If there is more air in the chamber, the deadening effect is softer. If the piston 5 goes down too rapidly, one can increase air inside the chamber in order to soften the drop. By using a hollow piston instead of a closed one, the compression effect is modified and the deadening is much softer. With a hollow piston, the down stroke behaves differently in comparison to a closed piston due to the difference in the air chamber volume. Although, in either case, the down stroke is the same, the difference in chamber volume causes the curve of the opposite force to differ during the down stroke. In contrast, in the case of a piston with a closed head, the increase of the opposite force rises asymptotically, whereas in a hollow piston the opposite force rises more slowly so as to cause the curve to be less steep. If the air pressure in the column is low, then the piston will plunge to the bottom. Therefore, it is necessary to increase the air pressure by adding air via the inlet valve.

It is to be understood that the examples described above are not meant to limit the scope of the present invention. It is expected that numerous variants will be obvious to the person skilled in the support column design art, without any departure from the spirit of the present invention. The appended claims, properly construed, form the only limitation upon the scope of the present invention.

We claim:

1. An oleopneumatic adjustable and deadened support column for a chair comprising:

i) a first cylindrical body, the base of which is adapted to be connected to the base of a chair and charged with compressed air;

ii) a second cylindrical body, co-axial with the first, and telescopically slidable therein, the upper end of said second body being adapted to be connected to the seat of a chair;

iii) a command bar co-axial with and inside said second body, operable by lever means under said chair seat, iv) first slidable piston means between said first and second body, said first piston means being annularly fixed around said second body, and in sliding, sealing engagement with the inner surface of said first body;

v) annular upper and lower floating piston means, respectively above and below said first piston means, between said first and second bodies, in sliding sealing engagement with same, said first, upper, and lower pistons defining upper and lower oil chambers between said first and second bodies;

vi) valve means in said second body, at the level of said first piston, actuatable by said command bar to permit or interdict the flow of oil between said first and second oil chambers; whereby said first, upper, and lower pistons are displaceable as an ensemble when weight is placed on the seat of said chair.

2. A support column as claimed in claim 1, said valve means includes a reciprocable draw piston at the end of said common bar, having three seal rings sliding inside said second body in an intermediate chamber formed by a lower piston casing and an upper piston casing, said chamber having two series of holes, one series above, and one series below said first piston means; whereby axial movement of said draw piston displaces the middle one of said three seal rings from a position between said series of holes interdicting the flow of the oil from one oil chamber to the other to a position permitting communication between the series of holes, thereby permitting the flow of oil.

3. A seat support as claimed in claim 2, wherein the lower of said series of holes is between said upper and lower piston casings, and said middle seal passes from a position in said upper casing, past said lower series of holes, to a position in said lower casing, to permit the flow of oil.

4. A seat support column as claimed in claim 1, said second body is internally hollow and opens at a lower end toward the interior of said first body, whereby said second body is urged upwardly by the pressurized air in said first body.

5. A seat support column as claimed in claim 4, the lower portion of said first body is set a lower tubular stop guide means axially guiding the lower part of said second body and acting as a lower stroke stop means for said lower floating piston as weight is placed on said seat of said chair and said second body moves downwardly, said lower floating piston being spaced from said stop guide to permit said compressed air to act to deaden the motion of said column.

6. A seat support column as claimed in claim 5, the two floating pistons are ring seal shaped and are slidable freely against the inner surface of the first and the outer surface of the second body, in order that the oil chambers may move with the second body as weight is placed on it.

7. A support column as claimed in claim 2, having internally in the second body a lower tubular stop means made of a plastic material that bears said lower closed piston casing, said lower casing containing a helical spring means bearing upwardly against said draw valve, said lower casing being sealed with a seal ring against the inside surface of said second body to prevent to the compressed contained air in the lower air chamber of said first body from escaping.

8. A support column as claimed in claim 2, wherein two series of holes corresponding to those of said lower and upper casings are formed in said second body just above, and just below said first slidable piston, and wherein annular seal means are provided on the exterior of said lower and upper casings, above, below, and between the two series of holes in said second body.

* * * * *